US007607857B1

(12) United States Patent
Swonger, Jr.

(10) Patent No.: US 7,607,857 B1
(45) Date of Patent: Oct. 27, 2009

(54) ASSURED SAFE FOLLOWING DISTANCE HIGHWAY MARKINGS

(76) Inventor: Karl William Swonger, Jr., 3788 Hillandale Rd., Toledo, OH (US) 43606

( * ) Notice: Subject to any disclaimer, the term of this patent is extended or adjusted under 35 U.S.C. 154(b) by 0 days.

(21) Appl. No.: 11/796,301

(22) Filed: Apr. 27, 2007

(51) Int. Cl.
*E01F 9/087* (2006.01)

(52) U.S. Cl. ..... 404/12

(58) Field of Classification Search ..... 404/9, 404/12, 93, 94, 72; 340/932
See application file for complete search history.

(56) References Cited

U.S. PATENT DOCUMENTS

| | | | | | |
|---|---|---|---|---|---|
| 2,338,894 | A * | 1/1944 | Beebe | 118/301 |
| 3,188,927 | A * | 6/1965 | Woods | 404/9 |
| 3,626,413 | A * | 12/1971 | Zachmann | 342/104 |
| 3,750,099 | A * | 7/1973 | Proctor | 340/932 |
| 4,030,958 | A * | 6/1977 | Stenemann | 156/350 |
| 4,227,772 | A * | 10/1980 | Heenan | 359/531 |
| 4,600,913 | A * | 7/1986 | Caine | 340/435 |
| 5,059,061 | A * | 10/1991 | Stenemann et al. | 404/72 |
| 5,235,316 | A * | 8/1993 | Qualizza | 340/436 |
| 5,249,027 | A * | 9/1993 | Mathur et al. | 356/3.14 |
| 5,293,162 | A * | 3/1994 | Bachalo | 340/905 |
| 5,516,227 | A * | 5/1996 | Kozak et al. | 404/9 |
| 5,572,449 | A * | 11/1996 | Tang et al. | 700/304 |
| 5,673,039 | A * | 9/1997 | Pietzsch et al. | 340/905 |
| 6,014,601 | A * | 1/2000 | Gustafson | 701/45 |
| 6,247,872 | B1 * | 6/2001 | Marcato | 404/94 |
| 6,413,012 | B1 * | 7/2002 | Jones | 404/94 |
| 6,679,650 | B2 | 1/2004 | Britt et al. | |
| 6,679,702 | B1 * | 1/2004 | Rau | 434/29 |
| 7,021,857 | B2 * | 4/2006 | Van Der Poel | 404/9 |
| 7,025,525 | B2 * | 4/2006 | Van Der Poel | 404/1 |
| 7,077,600 | B1 * | 7/2006 | Whinery | 404/14 |
| 7,147,400 | B2 * | 12/2006 | Van Der Poel | 404/9 |
| 2002/0128881 | A1 * | 9/2002 | Wahlbin et al. | 705/4 |
| 2002/0140551 | A1 * | 10/2002 | Gutta et al. | 340/435 |
| 2003/0149521 | A1 * | 8/2003 | Minowa et al. | 701/70 |
| 2004/0003572 | A1 * | 1/2004 | Flowers | 52/749.13 |
| 2006/0177265 | A1 * | 8/2006 | Cummings et al. | 404/9 |
| 2007/0106475 | A1 * | 5/2007 | Kondoh | 701/301 |

OTHER PUBLICATIONS

Stateline website, article State DOTs hope drivers see dots http://www.stateline.org/live/details/story?contentId=125133.*

* cited by examiner

*Primary Examiner*—Gary S Hartmann
(74) *Attorney, Agent, or Firm*—MacMillan, Sobanski & Todd, LLC

(57) ABSTRACT

The spacing of road markings is determined as a function of physical and/or environmental road conditions to provide a simple means for vehicle operators to maintain a safe following distance between motor vehicles.

9 Claims, 5 Drawing Sheets

ASSURED SAFE FOLLOWING DISTANCE HIGHWAY MARKINGS

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

This invention relates in general to highways and in particular to highway markings.

With the steady increase in the number of motor vehicles, highways are becoming more congested. At the same time, continual design improvements have resulted in significant ride and sound deadening enhancements to motor vehicles, while available engine horsepower has generally increased. Such improvements in the vehicles may result in higher speed operation without the operator sensing the increased speed. As a result, vehicle operators need to be increasingly attentive to the traffic conditions surrounding their vehicles. Nevertheless, drivers are known to follow other vehicles too closely, especially during rush hour traffic conditions, which can lead to multiple vehicle accidents.

In the past, many beginning vehicle operators have been taught to use a car-length rule for establishing a following distance for the vehicle immediately ahead. The car-length rule provides a space between the operator's vehicle and the vehicle ahead of one car length for every ten mph on the speedometer of the operator's vehicle. However, the car-length rule is no longer recommended because car lengths are difficult to estimate, nearly impossible to visualize when moving, and the rule may not provide enough space. For example, under the rule, six car lengths at 60 mph provides roughly 108 feet of space. At 60 mph, the reaction time for an alert vehicle operator consumes 60 to 130 feet. For a typical vehicle operator, who is often distracted by other factors such a cell phone or the broadcast being received over his vehicle radio, the reaction time may consume closer to 135 feet. Thus, with the car-length rule, after the vehicle operator reacts to the action of the vehicle ahead, there may be little or no time left to act.

Because of the problems described above, the car-length rule has generally been replaced by a two second rule that states that a vehicle operator should maintain at least two seconds of following distance. Application of the two second rule requires that the vehicle operator note when the vehicle immediately ahead passes an object, such as a sign post and then mentally count the elapsed time before his vehicle passes the same object. If less than two seconds pass, the operator does not have adequate space between his vehicle and the one ahead. Two seconds of following distance at 60 mph provides over 176 feet of pavement to react and respond. While it is necessary for the operator to respond quickly, it can be done under normal circumstances. However, application of the two second rule may be cumbersome and distracting to the vehicle operator. At best, the two second rule is applied intermittently (if at all) while driving. Accordingly, it would be desirable to provide a simple device to aid vehicle operators in maintaining spacing between their own and other vehicles on a continuous basis.

BRIEF SUMMARY OF THE INVENTION

This invention relates to highway markings that aid vehicle operators in maintaining adequate and safe vehicle spacing for the posted speed limit on the road segment on which they are traveling.

The invention contemplates a highway marking that consists of a plurality of markers with the markers having a spacing or length that is a function of a desired assured safe following distance for the road. The safe following distance is determined from physical and/or environmental road conditions which are considered when determining a speed limit for the road. One embodiment of the invention utilizes a segmented stripe painted upon a surface of a road with each of the stripe segments having a length that is equal to the safe following distance from the preceding vehicle. Another embodiment of the invention utilizes a markers placed along a road with each of the markers separated the safe following distance.

The present invention also contemplates a method for maintaining a safe distance between a first and a second motor vehicle that includes providing a plurality of markers with the markers separated by a length that is function of the desired assured safe following distance for the road. The speed of the second motor vehicle is adjusted if the vehicles are not separated by at least the distance separating two adjacent markers. One embodiment of the invention utilizes segmented stripes having the length of each segment being a function of the desired assured safe following distance for the road. For this embodiment, the speed of the second motor vehicle is adjusted if the vehicles are not separated by at least the length of one of the stripe segments Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
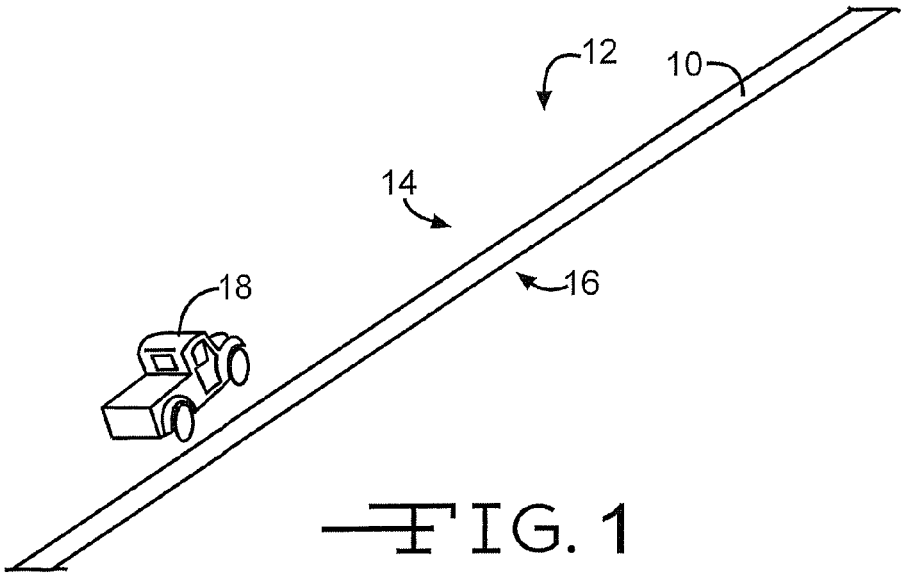
FIG. 1 illustrates a prior art continuous road marking stripe.

The present invention is intended to enhance traffic safety by encouraging the continuous awareness of adequate following space between a vehicle and an immediately preceding vehicle that provides an adequate reaction time for the operator of a following vehicle to avoid collisions. As such, the present invention also facilitates the application of the two second rule.

Referring now to the drawings, there is illustrated in FIG. 1*a* prior art road marking stripe 10 as appears along the edge of most United States and State routes. Typically, the stripe 10 is painted as a continuous, single narrow stripe along the edge of a road 12 to separate the paved portion of the road 14 from the road berm 16. Usually, the stripe 10 is painted with white reflective paint to enhance night time visibility. The stripe provides a visual aid to the operator of a vehicle 18 as the vehicle travels along the paved portion 14 of the road 12.

Figure 2:
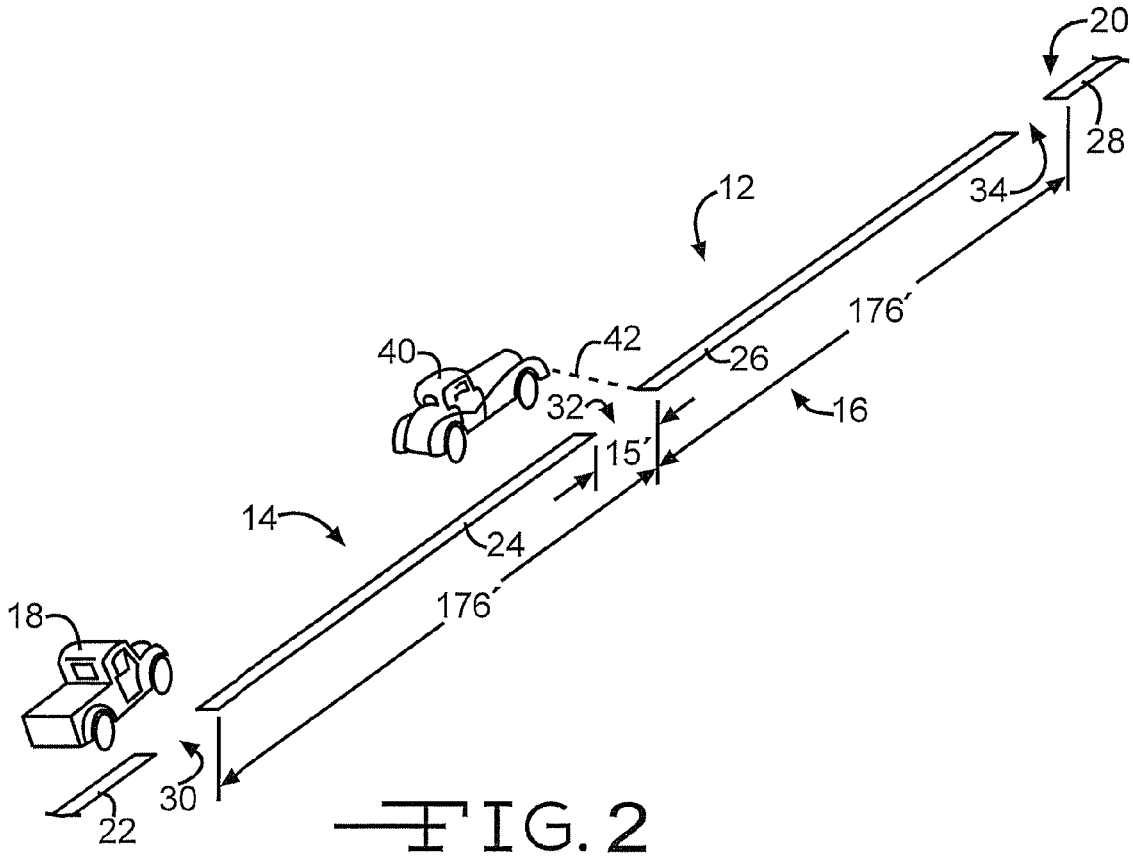
FIG. 2 illustrates a segmented road marking stripe that is in accordance with the present invention.

One embodiment of the present invention contemplates replacing the continuous road marking stripe 10 shown in FIG. 1 with a segmented road marking stripe 20, as illustrated in FIG. 2. Items shown in FIG. 2 that are the same as items shown in FIG. 1 have the same numerical identifiers. The segmented road stripe 20 includes segments 22, 24, 26 and 28, which are separated by spaces 30, 32 and 34. The length of segments 22, 24, 26 and 28 are determined to function as an aid to vehicle operators for visualization of an appropriate assured safe following distance to maintain vehicle spacing. As in the prior art stripe 10, each of the segments 22, 24, 26 and 28 is painted upon the road surface 14 with a light, preferably white, reflective paint.

The present invention contemplates that the length of the segments 22, 24, 26 and 28 are determined by road physical and/or environmental conditions. Road physical conditions include factors such as the safe or optimal following distance for the road segment as determined by the highway engineers. Thus, the length of line segments may change based upon the road surface coefficient of friction, as determined by the pavement material; i.e., concrete or asphalt, grade, visibility around curves, and desired road capacity. Environmental conditions include potential traffic congestion and distractions. Thus, a road in Montana, which is sparsely settled may well have longer line segments than a road in downtown Los Angeles where the traffic will be more dense. Distractions, which may occur along scenic roadways, may require longer segments to allow drivers more reaction time to stop since they may be looking off to the sides of the roads. Typically, both physical and environmental conditions are considered in selecting the posted speed limit. Accordingly, the invention also contemplates correlating the segment lengths to the posted speed limit.

In the embodiment of the invention illustrated in FIG. 2, each of the segments 22, 24, 26 and 28 has a length L that is determined by highway engineering references for the road type (asphalt, concrete, gravel, etc.), grade, and posted speed limit or the following formula if the nominal 2 second rule is to applied:

$$L=(S \text{ miles/hr.})*5{,}280 \text{ feet/mile}*(1/3{,}600)\text{hrs./second}*T \text{ seconds};$$

where: L is the segment length in feet;

S is the speed limit for the portion of road in miles per hour, 5,280 is a conversion factor to convert miles to feet;

$1/3{,}600$ is a conversion factor to convert hours to seconds; and

T is a calibration time period in seconds, which would be two seconds for the two second rule stated above.

As an example of the above formula, if it is desired to calibrate the segment lengths L for a posted speed limit of 60 miles per hour and a calibration time period of two seconds, the above equation yields:

$$L=60*5{,}280*(1/3600)*2=176 \text{ feet},$$

as shown in FIG. 2.

As shown in FIG. 2, the separating spaces 30, 32 and 34 have been arbitrarily assigned a length of 15 feet, which is considered to be exemplary. Other values for the spacing between segments may also be used as long as a criterion that the spaces are readily discernable is met. Another embodiment of the invention contemplates that the length of the separating spacing is increased for higher posted speed limits (not shown).

The use of the segmented road marking stripe 20 will now be described. As shown in FIG. 2, the vehicle 18 is following another vehicle 40. As the vehicles 18 and 40 travel down the road 12, the operator of the following vehicle 18 needs to keep at least the length of one segment between his vehicle and vehicle 40 being followed. The spacing is illustrated in FIG. 2 where the leading vehicle 40 is entering segment 26 while the following vehicle 18 is about to exit segment 22. Thus, the two vehicles 18 and 40 are separated by the length of the intermediate segment 24.

Figure 3:
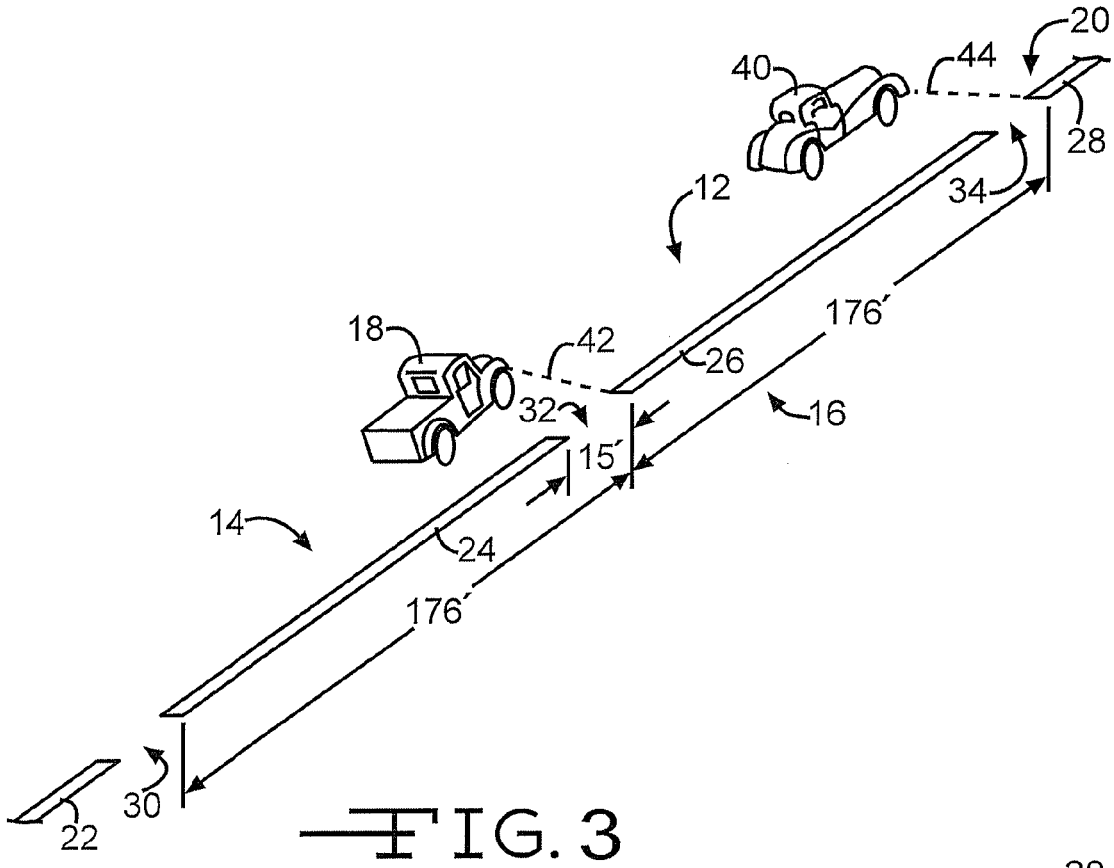
FIG. 3 illustrates an application of the road marking stripe shown in FIG. 2 for maintaining a safe spacing between two motor vehicles.

If the vehicles 18 and 40 are to remain separated by a safe distance, the leading vehicle 40 will be entering the beginning of the next segment 28 before the following vehicle 18 exits the segment labeled 24, as illustrated by the positions of the vehicles shown in FIG. 3. As shown in FIG. 3, the leading vehicle 40 passes the beginning of segment 28 as the following vehicle 18 passes the end of segment 24. It also can be readily seen from a comparison of FIGS. 2 and 3 that a safe distance is maintained provided the operator of the following vehicle 18 always maintains at least two of the spaces between segments between the front of his vehicle and the front of the leading vehicle 40. Thus, the present invention provides a convenient and simple method for maintaining assured safe following distances without estimating car lengths or applying the two second rule and having to determine the time required to pass an object.

Figure 4:
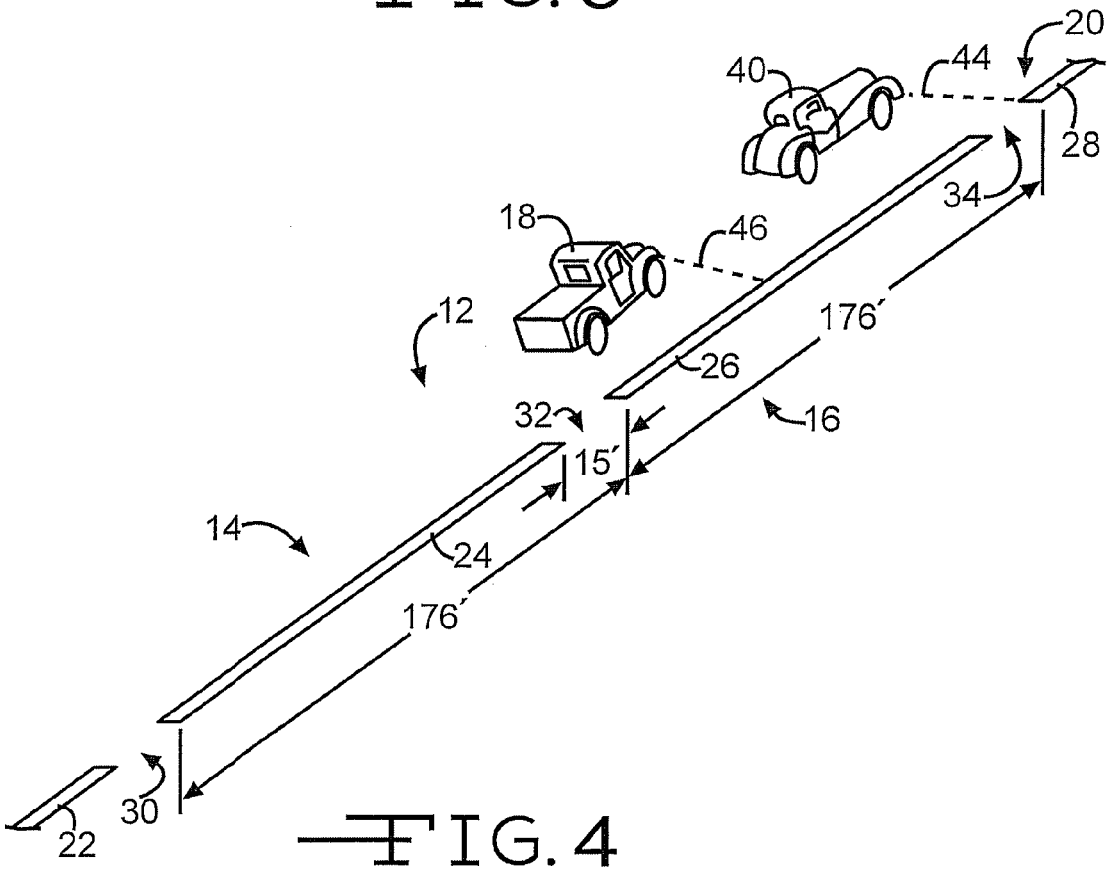
FIG. 4 illustrates another example of the application of the road marking stripe shown in FIG. 2.

Continuing with the above example, if the vehicle operator of the following vehicle 18 finds that his vehicle is within the length of the same segment occupied by the leading vehicle 40, then the distance between vehicles is less that the safe distance. Additionally, the following vehicle 18 may be traveling faster that warranted by the physical and/or environmental road conditions. When such a situation exists, the distance between vehicles may be decreasing. This situation is illustrated in FIG. 4 where the vehicles 18 and 40 are both within the end points of the same segment 26. Accordingly, the operator of the following vehicle 18 should either slow down or pass the leading vehicle 40.

Figure 5:
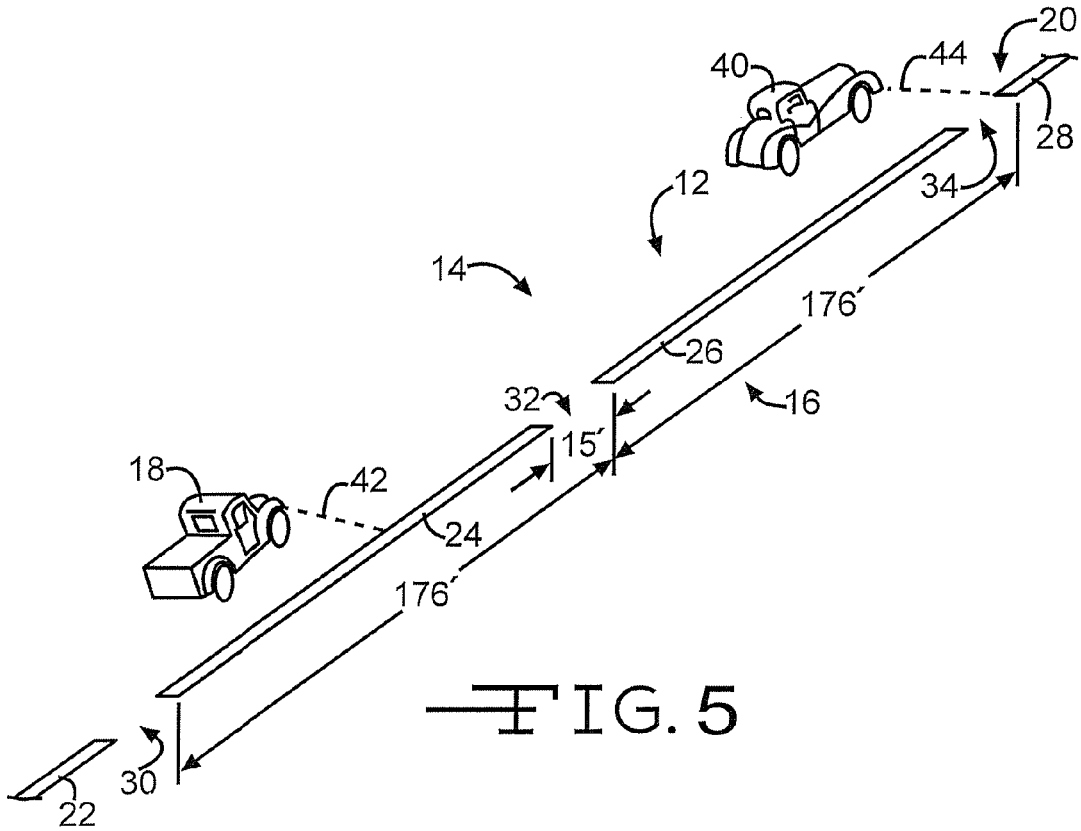
FIG. 5 illustrates another example of the application of the road marking stripe shown in FIG. 2.

Conversely, if the following vehicle 18 is more than one segment behind the leading vehicle 40, and the leading vehicle is traveling at a safe speed, the following vehicle is traveling below the safe speed and falling further behind the other vehicle 40. This situation is illustrated in FIG. 5 where the following vehicle 18 remains within the length of segment 24 while the leading vehicle 40 is entering the beginning of segment 28, with the segment 28 separated from segment 24 by the intervening segment 26. This situation also is indicative of a suboptimal loading of the road with vehicles, that is, the spacing between vehicles may be safely reduced, allowing more vehicles to be operated on the road.

Heavier vehicles, such as loaded trucks, generally require a much greater stopping distance than automobiles. As such trucks usually use a 4 second rule. Accordingly, the present invention contemplates that a truck operator would maintain at least two segments between his truck and a leading vehicle (not shown).

Figure 6:
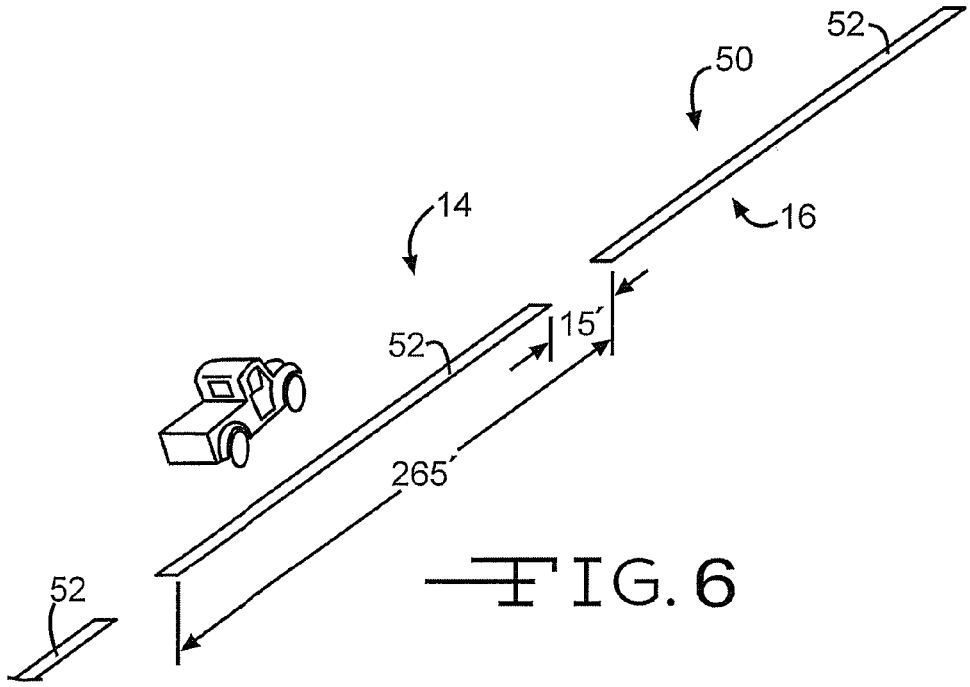
FIG. 6 illustrates an alternate embodiment of the road marking stripe shown in FIG. 2.

While a two second calibration time period is used to scale the length of the marking segments in the above examples, it will be appreciated that the use was intended to be exemplary and that the invention may be practiced utilizing other assured safe stopping distances as determined by highway engineering references as illustrated by the alternate embodiment 50 of the marking stripe having segments 52 shown in FIG. 6. The use of a longer segment would effectively increase the distance between vehicles.

It will be appreciated that the lengths of the stripe segments shown in FIGS. 2 and 6 are intended to be illustrative and not limiting. Thus, a stripe segment length would be calculated with the formula shown above for each particular posted speed limit. Therefore, when the posted speed limit changes, the length of the stripes also would change proportionally. Thus, if the speed limit increases from 60 mph to 70 mph, and the segments are calibrated for a two second calibration time period, the length of each segment would increase from 176 feet to 205 feet. Conversely, if the speed limit decreases from 70 mph to 50 mph, the length of each segment would decrease from 205 feet to 147 feet. Similarly, upon entering a congested area, the segment lengths may be shortened to encourage the vehicle operators to slow their vehicles. The changing length of the individual segments provides a visual reminder to the vehicle operator that the speed limit has changed.

Figure 10:
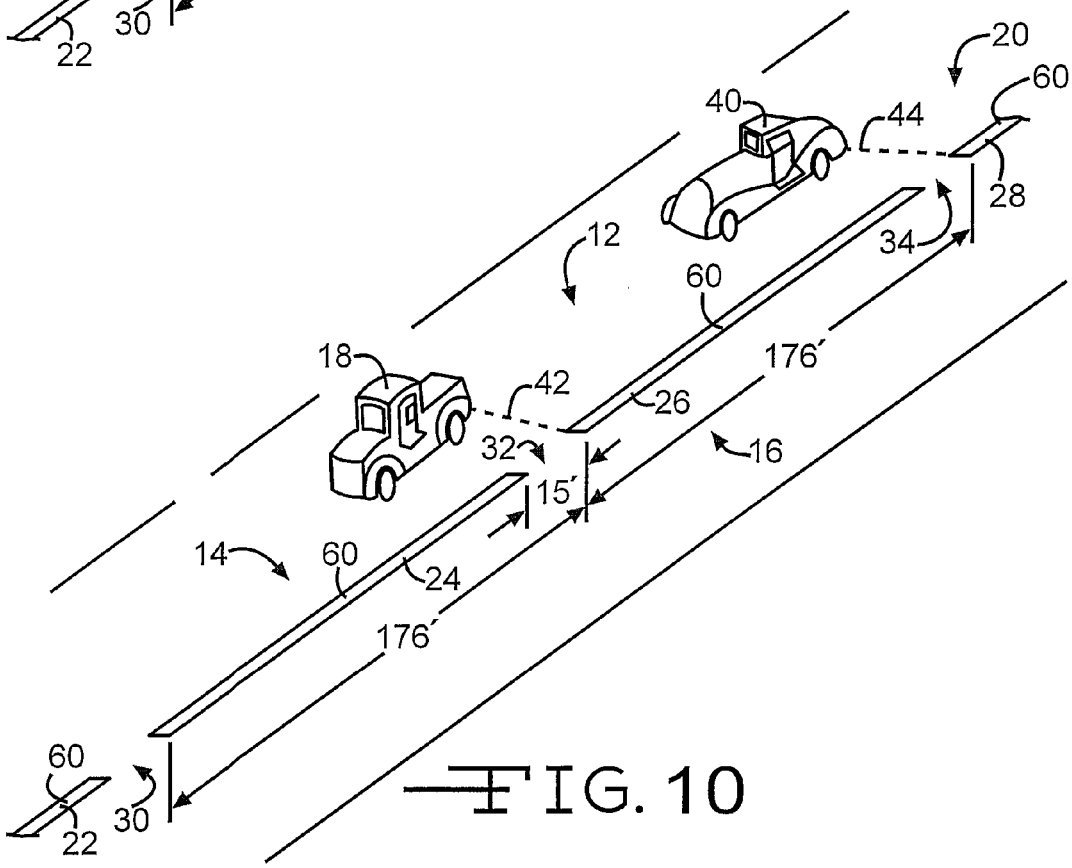
FIG. 10 illustrates an alternate embodiment of the road marking stripe shown in FIG. 2 with the marking stripe placed in the middle of the road.

While the embodiment of the invention described above contemplates painting the segmented stripes along the side of a road, the invention also may be practiced by painting calibrated segments 60 along center of the road as shown in FIG. 10. Often, a dashed line has previously been painted along the center of the road. Accordingly, application of the invention would consist of replacing the current center line dashes with calibrated segments. Where a solid center line is utilized to signify a no passing zone, the calibrated segments could be painted beside the solid center line (not shown). Additionally, while the invention contemplates applying the calibrated segments to both sides of the road, the invention also may be practiced by applying the calibrated segments to only one side of the road. Furthermore, the inventor estimates that replacement of current continuous side marker lines with calibrated segmented stripes would reduce the amount of paint by 5%-10% required to initially mark roads and to maintain the markings, thus reducing road maintenance costs.

Figure 8:
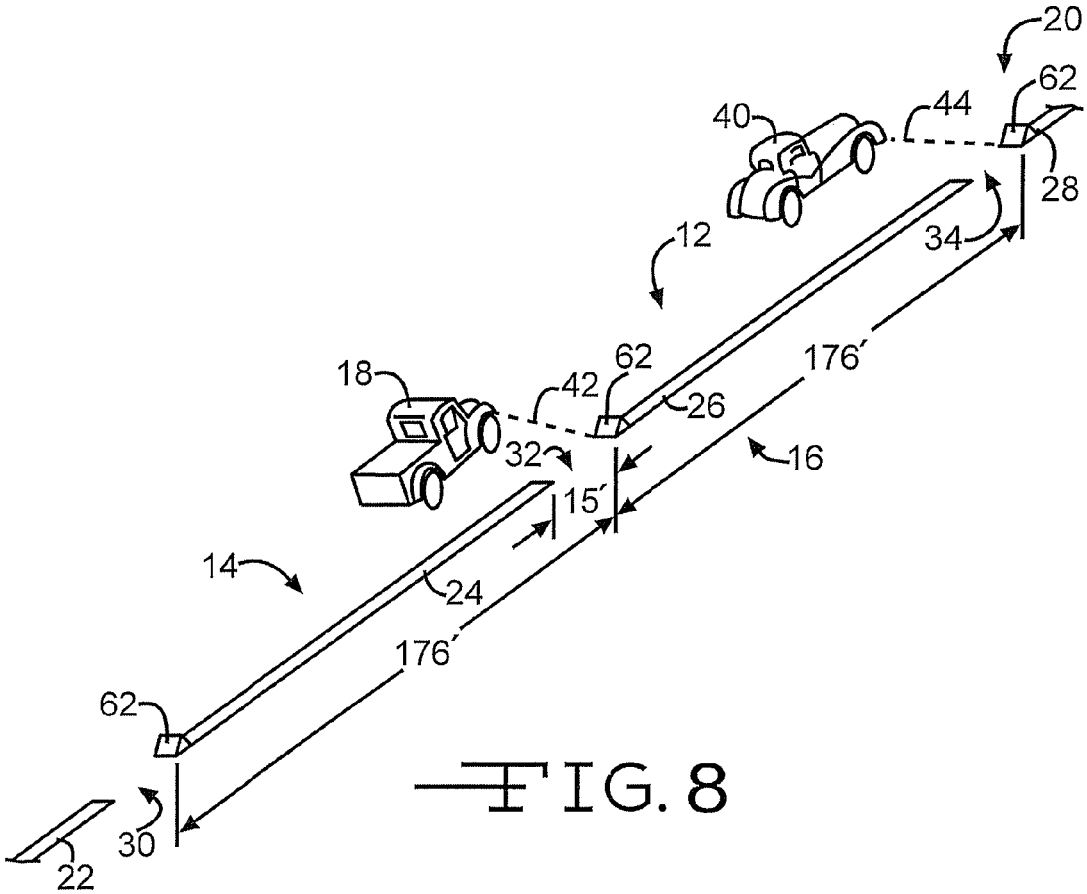
FIG. 8 illustrates an alternate embodiment of the road marking stripe shown in FIG. 2 that includes reflectors.

While the above embodiments above have been illustrated and described as utilizing segmented marking strips, the invention also contemplates use of other markers. For example, as shown in FIG. 8, reflective markers 62 may be installed along the road to define the assured safe following distance. The markers 62 would be separated by the desired assured safe following distance and a vehicle operator would endeavor to maintain a spacing at least equivalent to the spacing between two adjacent markers between his vehicle and the preceding vehicle. While the reflective markers 62 are shown in FIG. 8 in combination with segmented stripes 22, 24, 26 and 28, it will be appreciated that the invention also may be practiced with the reflective markers 62 only (not shown).

Figure 7:
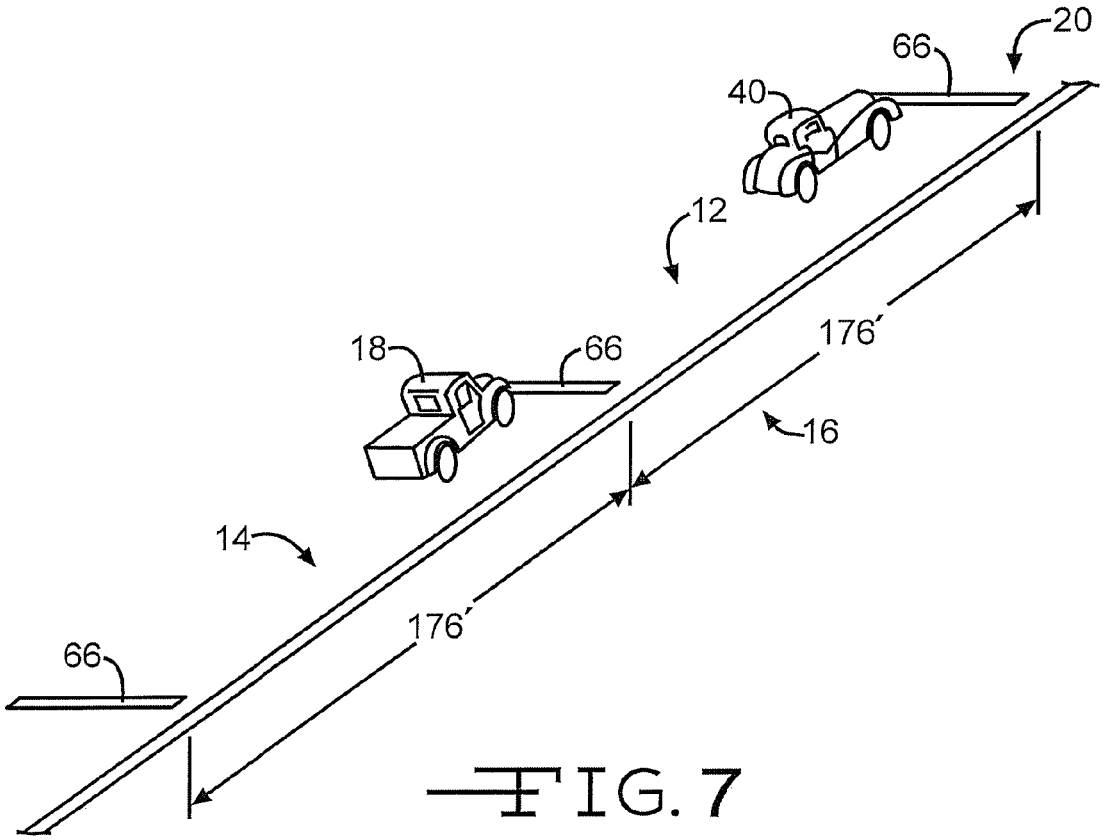
FIG. 7 illustrates another alternate embodiment of the road marking stripe shown in FIG. 2 that includes transverse markings.
Figure 9:
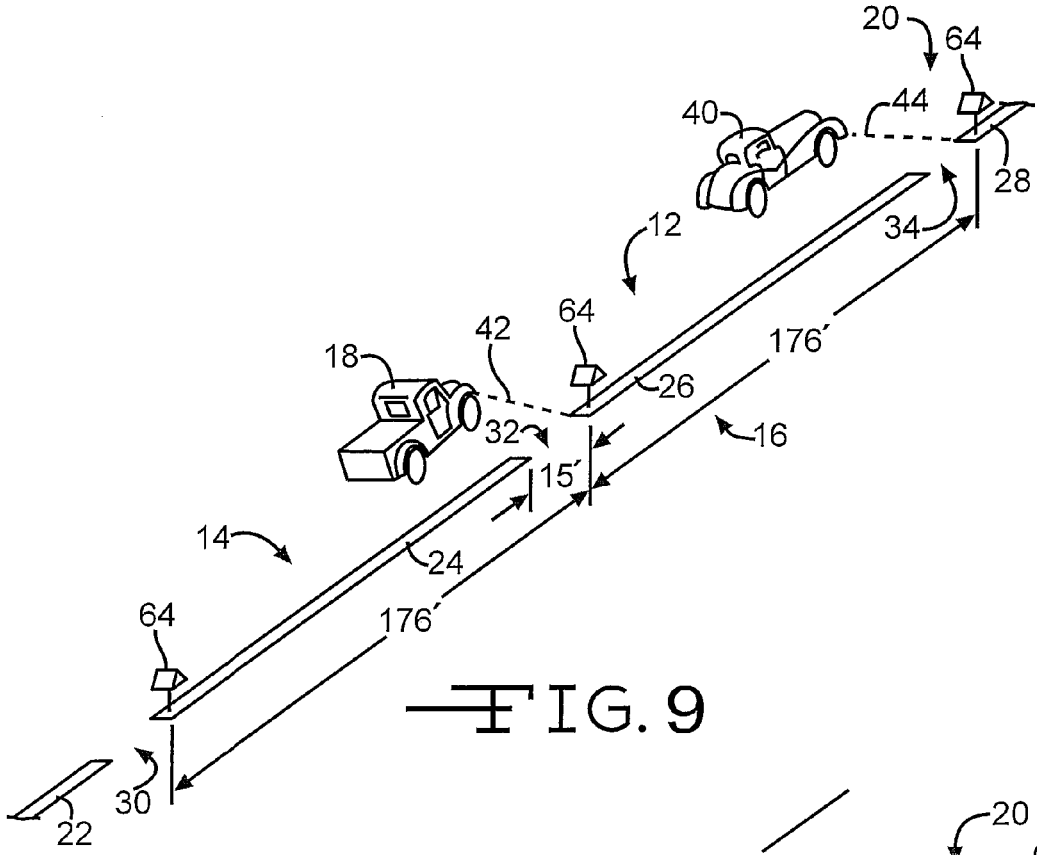
FIG. 9 illustrates an alternate embodiment of the road marking stripe shown in FIG. 2 that includes elevated reflectors.

Alternately, the reflective markers that are spaced apart by assured safe following distance may be mounted along the center line of the road or placed within the road lanes (not shown). In another embodiment, the vertically extending markers 64, as illustrated in FIG. 9, that are spaced apart by the assured safe following distance are utilized, such as sign posts, to include an optional reflector for night use. Such vertical markers 64 would be visible after a snowfall. While the reflective markers 62 are shown in FIG. 8 in combination with segmented stripes 22, 24, 26 and 28, it will be appreciated that the invention also may be practiced with the reflective markers 62 only (not shown). The invention also contemplates painting transverse lines 66 or dashes across the road that are separated by the assured safe following distance in place of the segmented stripes described above, as shown in FIG. 7.

The use of calibrated segments or marker spacing would also assist the enforcement of the speed limit. By noting the time needed by a vehicle to transverse one of the segments, a law enforcement office may estimate the speed of a vehicle. Thus, for the example shown in FIG. 2, if a vehicle takes less than two seconds to pass one of the segments, the vehicle is exceeding the speed limit.

While the invention has been illustrated and described with reference to English units of measure, the invention also may be practiced utilizing metric units of measure, in which case the equations given above become:

$$L=(S\ \text{km/hr.})*1{,}000\ \text{meters/km}*(1/3{,}600)\text{hrs./second}*T\ \text{seconds};$$

where: L is the segment length in meters;

S is the speed limit for the portion of road in kilometers per hour, 1,000 is a conversion factor to convert kilometers to meters;

1/3,600 is a conversion factor to convert hours to seconds; and

T is again a calibration time period in seconds.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A road marking system comprising a plurality of equally spaced segmented stripes placed upon a surface of a portion of a road with each of said stripes having a length that is directly proportional to a posted speed limit, such that a desired assured safe following distance is maintained for said portion of said road.

2. The road marking system according to claim 1 wherein said safe following distance is also a function of at least one of a road physical condition and a road environmental condition.

3. The road marking system according to claim 2 wherein said at least one of said road physical condition and a road environmental condition determines said speed limit for posting.

4. The road marking system according to claim 1 wherein said segmented stripes are painted parallel to the road direction and further wherein the length of each stripe segment is determined in accordance with the following formula:

$$L=(S\ \text{miles/hr.})*5{,}280\ \text{feet/mile}*(1/3{,}600)\text{hrs./second}*T\ \text{seconds};$$

where: L is the segment length in feet;

S is the speed limit for the portion of road in miles per hour, 5,280 is a conversion factor to convert miles to feet;

$1/3{,}600$ is a conversion factor to convert hours to seconds; and

T is a calibration time period in seconds.

5. The road marking system according to claim 1 wherein said segmented stripes are painted parallel to the road direction and further wherein the length of each stripe segment is determined in accordance with the following formula:

$$L=(S\ \text{km/hr.})*1{,}000\ \text{meters/km}*(1/3{,}600)\text{hrs./second}*T\ \text{seconds};$$

where: L is the segment length in meters;

S is the speed limit for the portion of road in kilometers per hour, 1,000 is a conversion factor to convert kilometers to meters;

$1/3{,}600$ is a conversion factor to convert hours to seconds; and

T is again a calibration time period in seconds.

6. The road marking system according to claim 4 wherein said stripe segments are applied to at least one side of said road.

7. The road marking system according to claim 4 wherein said stripe segments are applied to the center of said road.

8. The road marking system according to claim 4 wherein said length of each stripe segment changes with changes of said posted speed limit.

9. A method for maintaining a safe spacing between a first motor vehicle and a second motor vehicle with the second motor vehicle following the first motor vehicle, the method comprising the steps of:

(a) providing a plurality of equally spaced segmented stripes that are placed upon a surface of a portion of the road and with the stripes being oriented to be parallel to the road and with the length of each of the stripe segments being directly proportional to a posted speed limit for the portion of the road; and (b) adjusting the speed of the second motor vehicle as needed to maintain the position of the second motor vehicle behind the position of the first motor vehicle by at least the length of one of the stripe segments such that a safe following distance is provided between the first and second vehicles.

* * * * *